US009370284B2

(12) United States Patent
Moller et al.

(10) Patent No.: US 9,370,284 B2
(45) Date of Patent: Jun. 21, 2016

(54) RETENTION MECHANISM IN A DISPENSER FOR RETAINING AN EXCHANGEABLE ROLL OF MATERIAL, RETENTION SYSTEM, DISPENSER, AND METHOD FOR INSERTING A ROLL OF MATERIAL INTO SUCH A RETENTION MECHANISM

(75) Inventors: Per Moller, Leksand (SE); Martin Bonnevier, Vikmanshyttan (SE); Joonas Jokitalo, Borlange (SE); Oskari Jokitalo, legal representative, Borlange (SE); Craig Billman, Phoenixville, PA (US); Erik Hjort, Sater (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 421 days.

(21) Appl. No.: 13/997,822

(22) PCT Filed: Dec. 27, 2010

(86) PCT No.: PCT/EP2010/070746

§ 371 (c)(1),
(2), (4) Date: Sep. 6, 2013

(87) PCT Pub. No.: WO2012/089233

PCT Pub. Date: Jul. 5, 2012

(65) Prior Publication Data

US 2014/0001304 A1 Jan. 2, 2014

(51) Int. Cl.
*B65H 16/06* (2006.01)
*A47K 10/38* (2006.01)
(Continued)

(52) U.S. Cl.
CPC ..... *A47K 10/3809* (2013.01); *A47K 10/38* (2013.01); *A47K 2010/3681* (2013.01); *B65H 75/246* (2013.01); *B65H 75/247* (2013.01)

(58) Field of Classification Search
CPC ..... B65H 75/246; B65H 75/245; A47K 2010/3681; A47K 10/3809; A47K 10/3818; A47K 10/3845; A47K 10/3872
USPC ..... 242/597.6
See application file for complete search history.

(56) References Cited

U.S. PATENT DOCUMENTS 2,334,689 A 11/1943 Wooster
2,905,405 A 9/1959 Burton et al.
(Continued)

FOREIGN PATENT DOCUMENTS

AT 398747 B 1/1995
CN 1104577 A 7/1995
(Continued)

OTHER PUBLICATIONS

Decision on Grant issued Mar. 31, 2015 in corresponding Russian patent application No. 2013135012 (and English translation thereof) (16 pages).
(Continued)

*Primary Examiner* — Howard Sanders
(74) *Attorney, Agent, or Firm* — Drinker Biddle & Reath LLP

(57) ABSTRACT

A retention mechanism in a dispenser for retaining an exchangeable roll of material, the retention mechanism includes a housing including a front wall. An insertion slot for a bearing pin of an end plug of the exchangeable roll extends along the front wall. A cam lock is arranged in the housing so as to be rotatable in a plane which is parallel to the front wall and to the direction of extension of the insertion slot. The cam lock includes a retaining member which is movable between an open position and a locked position by rotating the cam lock. When the retaining member is in the open position, the bearing pin can be inserted into the insertion slot, and when the retaining member is in the closed position, the bearing pin is retained in a locking section of the insertion slot.

14 Claims, 7 Drawing Sheets

(51) Int. Cl.
*A47K 10/36* (2006.01)
*B65H 75/24* (2006.01)

(56) References Cited

U.S. PATENT DOCUMENTS

| | | | | |
|---|---|---|---|---|
| 5,562,393 | A | 10/1996 | Focke et al. | |
| 6,749,149 | B1 | 6/2004 | Friesen | |
| 6,964,395 | B1 | 11/2005 | Lewis et al. | |
| 7,284,725 | B2 * | 10/2007 | Inana | B41J 15/042 242/578 |
| 8,006,929 | B2 | 8/2011 | Lind et al. | |
| 8,490,913 | B2 * | 7/2013 | Formon | B65H 75/185 242/596.7 |
| 2008/0229791 | A1 * | 9/2008 | Granger | A47K 10/38 70/182 |

FOREIGN PATENT DOCUMENTS

| | | | |
|---|---|---|---|
| CN | 101326116 | A | 12/2008 |
| EP | 0657134 | B1 | 11/1997 |
| RU | 2376924 | C2 | 12/2009 |
| WO | WO 96/23719 | A1 | 8/1996 |
| WO | WO-2005/094653 | A1 | 10/2005 |
| WO | WO-2007/038957 | A1 | 4/2007 |
| WO | WO-2007/065686 | A2 | 6/2007 |

OTHER PUBLICATIONS

English-language translation of a First Office Action dated Jun. 2, 2015 issued in corresponding Chinese patent application No. 201080070961.X (8 pages).

* cited by examiner

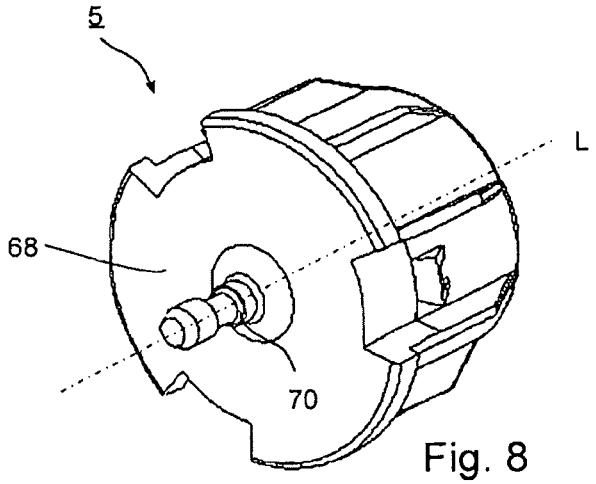
Fig. 8
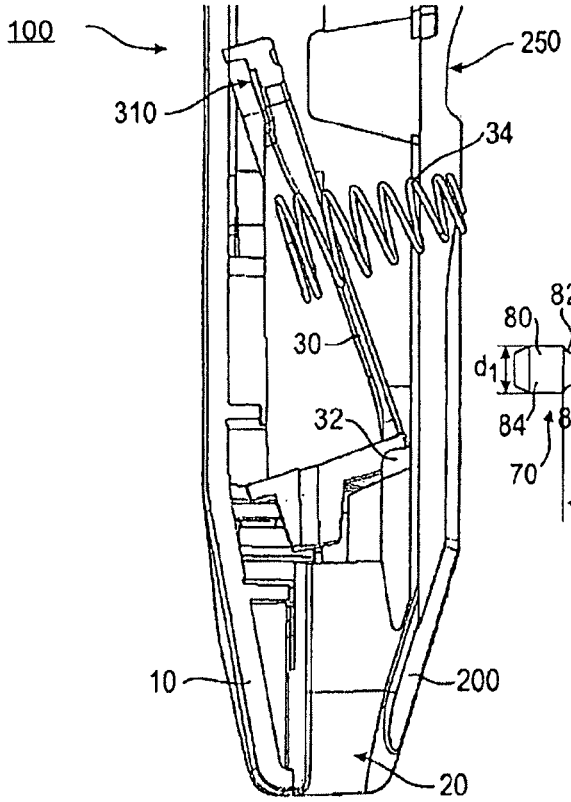
Fig. 9
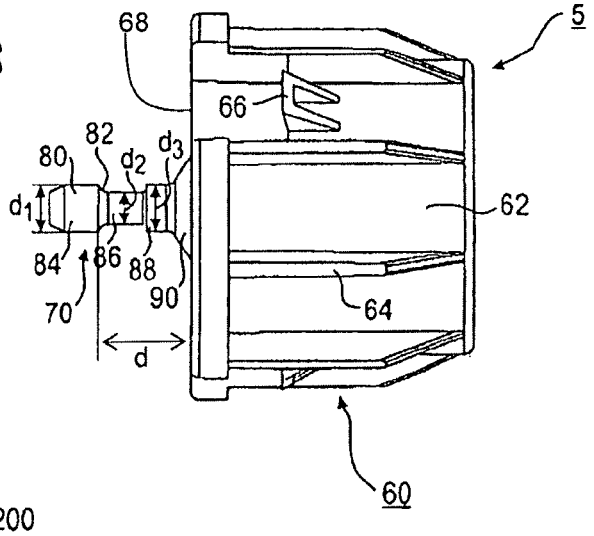

RETENTION MECHANISM IN A DISPENSER FOR RETAINING AN EXCHANGEABLE ROLL OF MATERIAL, RETENTION SYSTEM, DISPENSER, AND METHOD FOR INSERTING A ROLL OF MATERIAL INTO SUCH A RETENTION MECHANISM

CROSS-REFERENCE TO PRIOR APPLICATION

This application is a §371 National Stage Application of PCT International Application No. PCT/EP2010/070746 filed Dec. 27, 2010, which is incorporated herein in its entirety.

TECHNICAL FIELD

The disclosure relates to the technical field of dispensers for exchangeable rolls such as paper rolls and the suitable geometry for inserting such rolls into such dispensers.

In particular, the disclosure relates to a retention mechanism in a dispenser for retaining an exchangeable roll of material, a retention system, a dispenser, and a method for inserting a roll of material into such a retention mechanism.

BACKGROUND

Numerous prior dispensers are known for dispensing paper towels, kitchen paper, toilet paper, foil, plastics wrapping sheet and other materials wound onto a roll. Usually, such dispensers are provided with a supporting guiding bracket having support members in the form of arms upon each of which an end of an exchangeable roll is rotatably mounted. One of the support arms usually carries a hub member rotatably supported thereon over which one end of the roll core is inserted in replacing the roll. To the other end of the roll, an end plug is secured which is inserted in a retention mechanism in the other support arm of the dispenser. By means of providing an end plug only on one side of the roll, the correct placement of the supply roll relative to the dispensing mechanism and, consequently, the proper feeding of the sheet material is ensured.

In the prior art, different suggestions have been made in order to ensure the proper feeding of dispensers or to prevent the insertion of unauthorized rolls such as paper rolls of inferior quality into a dispenser.

U.S. Pat. No. 2,334,689 deals with the problem of providing dispensers with means to prevent any but a particular type of towel roll being inserted. As a solution to this problem, the paper roll and the paper thereon are provided with a groove at one longitudinal end. Only paper rolls with such a groove can be inserted into the dispenser. If a paper roll without such groove but of shorter longitudinal dimensions is used, it cannot rest on a support structure provided in the dispenser.

EP 0 657 134 B1 provides a solution to the problem of preventing the wrong insertion of paper rolls into a dispenser. The paper rolls are provided with plugs on both sides, the plug on the one side having a larger diameter and a slot which divides the pin into two crescent-shaped segments. This geometry is adapted to match a specific receiving geometry of the dispenser which is provided with corresponding depressions for receiving the crescent-shaped segments of the bearing pin.

Based on the object of preventing unauthorized use of paper rolls, U.S. Pat. No. 2,905,405 describes a coupling mechanism having openings of a special shape within a flange plate of the dispenser. The end plugs of the exchangeable replacement rolls have matching projections to be inserted through these openings. The projections of the end plugs inserted through the openings press on leaf springs that bias them into a position in which they do not impede the proper operation of the dispenser. Only replacement paper rolls having matching projections can be used in order to operate each individual leaf spring.

Another similar technical solution is known from U.S. Pat. No. 6,749,149 B1. The dispenser described therein has support arms for supporting a paper towel roll having a selected geometry with protrusions shaped to fit into matching openings in the end faces of the paper towel roll.

WO 2005/094653 A1 relates to a lock mechanism for a dispenser, an exchangeable roll of material and an end plug therefor and a method for inserting a roll of material into such a lock mechanism. The roll is provided with at least one end plug with a bearing pin for mounting the roll to the lock mechanism of the dispenser. The lock mechanism includes a lock-housing with a guide slot for insertion of the bearing pin, the guide slot having a first section with a first width and a second section with a second width which is smaller than the first width. First and second sections are arranged in a direction perpendicular to the longitudinal extension of the guide slot and in a longitudinal direction of the bearing pin to be received. A sliding element is mounted to the lock housing and movable between a first position closing or narrowing the width of the guide slot and a second position opening the guide slot. A lock element is mounted to the sliding element and rotationally movable around an axis of rotation between a locked position and an unlocked position. The lock element is provided with an engagement portion which, in a locked position, is engaged with a locking geometry of the lock housing.

From WO 2007/065686 A2, a related end plug for a roll of material and retention mechanism in a dispenser are known.

WO 2007/038957 A1 also discloses a related retention mechanism in a dispenser for retaining an exchangeable roll of material.

SUMMARY

It is desired to provide a retention mechanism in a dispenser for retaining an exchangeable roll of material, such that the insertion of a replacement roll is easy, but the use of an inappropriate replacement roll is effectively prevented. A retention system and a dispenser with these features as well as a method for inserting an exchangeable roll of material into a retention mechanism shall also be provided.

This can be solved by a retention mechanism in a dispenser for retaining an exchangeable roll of material according to embodiments disclosed herein.

The present retention mechanism is designed for being arranged on one of the two support arms of a dispenser.

In a first aspect, the retention mechanism includes a housing including a front wall, wherein an insertion slot for a bearing pin of an end plug of the exchangeable roll extends along the front wall. A cam lock is arranged in the housing so as to be rotatable in a plane which is parallel to the front wall and to the direction of extension of the insertion slot. The cam lock includes a retaining means which is movable between an open position and a locked position by rotating the cam lock in said rotational plane. In the open position of the retaining means, the bearing pin of the end plug can be inserted into the insertion slot. When the retaining means have arrived in the locked position, the bearing pin has reached its final position within a locking section of the insertion slot.

Consequently, the present disclosure provides a novel retention mechanism for retaining the known end plug. The retention mechanism employs a cam lock which is rotatably supported, and rotation of the cam lock brings the retaining means thereof from an open into a locked position. The cam lock is arranged so as to be rotated in a plane which is substantially parallel to the front wall of the housing in which the insertion slot is formed. In other words, the cam lock does not rotate perpendicular to the front wall including the slot but parallel to the direction of extension of the slot. The present mechanism therefore requires only a relatively short lead in for proper function, rather than a long ramp for the pin head to slide against. At the same time the present mechanism can be constituted in a compact manner.

Note that, even when the bearing pin is described herein to be "locked" or "fixed", it still may be rotated about its axis. The retaining means locks the retention pin in the locking section of the insertion slot only with regard to its movement along the insertion slot, but does not restrict any rotational movement of the pin about its axis.

At the same time, the present retention mechanism is still arranged such that an exchange of the exchangeable rolls of material is easy but the retention mechanism prohibits the insertion of a bearing pin of an end plug carrying the exchangeable roll of material that has inappropriate or unsuited dimensions. The retention mechanism effectively enables the rejection of inappropriately dimensioned bearing pins. The rejection of bearing pins of inappropriate dimensions has the effect that only rolls of material that carry an end plug with the correct dimensions will be accepted by the retention mechanism. The manufacturer of the rolls of material can, thus, provide the specific rolls of material with end plugs having bearing pins with specific dimensions that fit into the respective retention mechanism. This ensures that only the appropriate or correct rolls of material can be inserted into the retention mechanism and locked in their respective end position. Thus, the burden of re-checking whether the correct roll is inserted into the retention mechanism in the correct orientation is taken from the user, since only correct rolls in the correct orientation can be inserted and retained in the retention mechanism. The danger of damaging or clogging the dispenser is, thus, prevented.

If, for example, the user tried to insert an end plug having a rather thin bearing pin without any head portion into the present retention mechanism, such an end plug could not be locked by the retaining means. Such an inappropriately dimensioned bearing pin will not be able to cooperate with the retaining means of the cam lock and the housing in order to retain the bearing pin in its final position in the insertion slot. In other words, if the bearing pin is too thin and/or lacks a head portion, it is impossible to lock the bearing pin in its end position.

On the other hand, if a bearing pin is too thick in certain portions, it cannot readily be inserted into the insertion slot or at least not engage with the retaining means and thus cannot be locked in its end position.

In both cases, the bearing pin will be rejected in the sense that it cannot be locked in the intended end position. It can then either not be slid through the insertion slot at all or cannot be locked in the locking section of the slot, but is ejected from the insertion slot by means of the cam lock.

Optional features are also recited in the disclosure and dependent claims.

In certain embodiments, the retention mechanism is so arranged that movement of the bearing pin along the insertion slot causes an engagement between the pin and the retaining means, a rotation of the cam lock and accordingly a movement of the retaining means into the locked position. In other words, as the user pushes the end plug into the insertion slot, the bearing pin of the end plug engages with the retaining means of the cam lock and entrains the retaining means so as to move into the locked position.

In a further embodiment, when the retaining means are in the locked position, the retaining means of the cam lock and the housing can cooperate with the bearing pin in order to retain the bearing pin within the locking section of the insertion slot. As regards the particular manner in which the bearing pin, the retaining means of the cam lock and the housing cooperate in order to retain the bearing pin in the locked position, the retaining means of the cam lock can, for example, be arranged so as to be sandwiched between a head portion of the pin and an inner surface of the front wall of the housing when the retaining means is engaged with the bearing pin. In this manner, the retaining means of the cam lock can be drawn further towards the housing wall by means of the head portion, in order to establish friction there between.

Furthermore, the cam lock can be pre-tensioned into the open position. This ensures that the entrance to the insertion slot is normally left open. The pre-tensioning can for example be effected by means of a coil spring which is connected with the cam lock on its one end and with the housing on its other end.

The insertion slot suitably includes an entrance section via which the bearing pin enters the slot, a sliding section, and the locking section accommodating the bearing pin in its final position. The insertion slot is further suitably delimited by an upper and a lower supporting surface each including a guide rail extending along at least part of the sliding section. The guide rails are arranged and constructed for guiding the bearing pin along the sliding section of the insertion slot and into the locking section thereof.

In order to provide efficient cooperation between the end plug and the retention mechanism, the guide rails extending along the insertion slot can be arranged and constructed so as to guide a cone formed on the end plug along the insertion slot.

Turning now in more detail to the manner in which the bearing pin is retained in the locking section of the insertion slot, the housing may further include interference means formed alongside the insertion slot which the bearing pin passes on its way along the insertion slot and into the locking section thereof, wherein these interference means help retaining the bearing pin within the insertion slot and/or provide a tactile and/or audible feedback for the user indicating that the exchangeable roll of material has been correctly inserted. The interference means can be provided at the transition between the sliding section and the locking section of the insertion slot so that the bearing pin has to overcome the interference means in order to arrive at its final position. The interference means may for example be provided in the form of at least one bulge, which is formed on the upper and/or the lower supporting surface delimiting the insertion slot so as to extend further into the insertion slot and/or in a direction perpendicular thereto than the guide rails. In other words, the bulge projects in a direction perpendicular and/or parallel to the axial direction of the bearing pin. The bulge(s) may for example be formed at the transition between the sliding section and the locking section of the insertion slot, and may enable the user to feel a slight resistance in the movement when urging a correct end plug into its end position.

In the case that an inappropriately dimensioned bearing pin is used, in particular one that does not have a head and neck portion at all, a locking condition can either not be achieved or the inappropriately dimensioned bearing pin cannot pass the bulge(s). The inappropriately dimensioned bearing pin is, thus, rejected and cannot be locked in the correct end position.

The housing can have an open back face which is closed by means of a back plate. This facilitates assembly of the retention mechanism.

The back plate can not only close the housing but also aids in guiding the bearing pin along the insertion slot. To this end, the back plate may also be provided with a guide rail, which can be so arranged and constructed as to guide a head portion of the bearing pin of the end plug along the insertion slot.

In certain embodiments, therefore, the cone of the end plug is guided by means of the guide rails provided in the housing, while the head portion of the pin is guided by means of the guide rail provided on the back plate. The neck portion of the pin is not guided, but free to become engaged with the retaining means of the cam lock.

The retaining means of the cam lock can be provided in the form of a hook arranged and constructed for cooperating with a neck portion of the bearing pin. Engagement between the retaining means and the pin is thereby facilitated, given that the pin has a matching structure. In case the pin has too large a diameter, it cannot be engaged with the hook and not properly be retained within the present retention mechanism. The hook shaped retaining means therefore provides another means for excluding unsuitable end plugs from use.

The back plate may also include interference means which the bearing pin passes on its way along the insertion slot and into the locking section, wherein these interference means help retaining the bearing pin within the insertion slot and/or provide a tactile and/or audible feedback for the user indicating that the exchangeable roll of material has been correctly inserted. The interference means may simply be provided as a bend formed in the guide rail of the back plate, so as to protrude into the insertion slot and/or in a direction perpendicular thereto.

It can, therefore, be said that the retention of the bearing pin within the locking section of the insertion slot is accomplished by three different measures: a) by means of the friction established between the retaining means of the cam lock and the inner surface of the housing, b) by means of a first interference feature provided in the form of the bulges formed alongside the insertion slot, and c) by means of a second interference feature provided in the form of the bend in the guide rail provided on the back plate.

In certain embodiments, the system combines the specific features of the retention mechanism with a correspondingly shaped end plug with a specific bearing pin such that a reliable and secure exchange of a roll of material can be performed easily.

In certain embodiments, the dispenser may include two support arms, one of which carries a hub member rotatably supported thereon over which one end of the roll core is inserted in replacing the roll. The retention mechanism would be provided in the other support arm of the dispenser. By means of providing an end plug only on one side of the roll, the correct placement of the supply roll relative to the dispensing mechanism and, consequently, the proper feeding of the sheet material is ensured.

Both support arms of the dispenser may be flexible in the horizontal direction allowing them to flex out of the way for roll loading and unloading.

A method for inserting an exchangeable roll of material is also disclosed.

BRIEF DESCRIPTION OF THE DRAWINGS

In the following, an exemplary embodiment will be described in detail with reference to schematic drawings in which:

FIG. 8 is a perspective view of an end plug to be used together with the exemplary retention mechanism of FIG. 1; and FIG. 9 shows the end plug of FIG. 8 and a prior art retention mechanism.

DETAILED DESCRIPTION OF PREFERRED EMBODIMENTS

Figure 1:
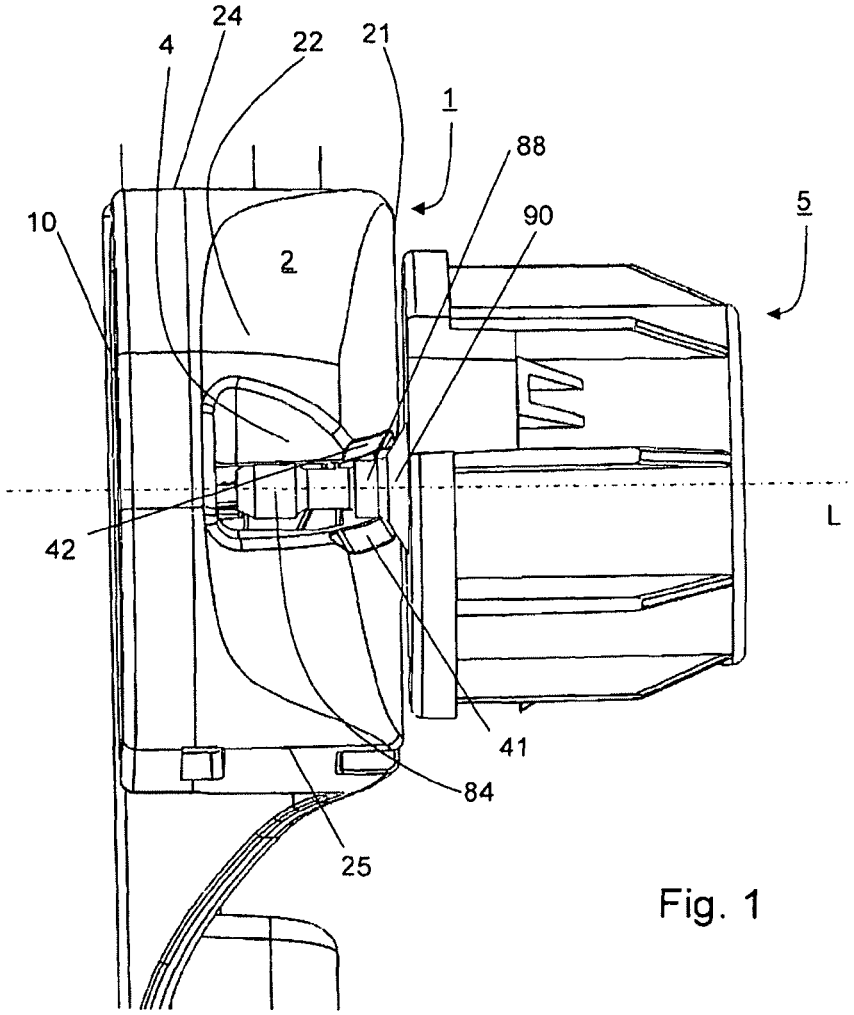
FIG. 1 is a side view of an exemplary retention mechanism with an end plug inserted into the insertion slot thereof.

A retention mechanism according to the present disclosure will now be described with reference to the attached drawings.

To this end, first of all, an end plug will be described which can suitably be used in combination with the retention mechanism according to embodiments of the present invention. The attached FIG. 8 shows a perspective view of such an end plug 5, as it is described in, for example, WO 2007/065686 A2. FIG. 9 shows a side view of the same end plug 5 and of a prior art retention mechanism 100.

The end plug 5 has a receiving portion 60 which is dimensioned to fit into a hollow core of a roll of material (not shown), in particular a roll of tissue paper material such as paper towels or toilet paper. The receiving portion includes a cylindrical portion 62 and a plurality of ribs 64 that expand radially from the cylindrical portion 62. The hollow core of the roll of material is fitted onto the summit portions of the radially expanding ribs 64. Fluke portions 66, equally extending radially from the cylindrical portion 62 of the receiving portion 60, serve to hold the hollow roll of material in place when the end plug is fitted into the core. The fluke portions 66 extend beyond the radial expansion of the ribs 64 such that they enter into the core material in order to secure the end plug in the core. An end face 68 of the receiving portion 60 is adapted to abut against an outer wall of the retention mechanism.

A longitudinal axis of the end plug 5 is designated "L".

The end plug 5 further includes a bearing member 70 for being inserted into the retention mechanism, the bearing member 70 extending away from the receiving portion in the axial direction of the end plug 5. The bearing member 70 has a bearing pin 80 which in turn includes a head portion 84 of a first outer diameter $d_1$ that springs back into a neck portion 86 that has an outer diameter $d_2$ which is smaller than the first diameter $d_1$. Furthermore, the bearing pin 80 includes a shoulder portion 88 of a third outer diameter $d_3$ which, in this embodiment, is equal to the first diameter $d_1$.

A counter surface 82 connects the head portion 84 with the neck portion 86 of the bearing pin 80. The counter surface 82 may have different forms. In the embodiment shown here, it is inclined with regard to the longitudinal axis of the bearing pin. However, it could also be perpendicular to the longitudinal axis of the bearing pin 80, or chamfered.

A cone 90 connects the bearing member 70 of the end plug 5 with the receiving member 60 thereof. In the embodiment shown here, the cone 90 and the counter surface 82 are arranged such that they are inclined in opposite directions.

FIG. 9 also shows a prior art retention mechanism 100 (also described in WO 2007/065686 A2) in which the end plug 5 can be retained. The retention mechanism 100 includes a housing 10 which can be made from a moulded plastic material. The housing 10 includes an insertion slot 20 for the insertion of the bearing member 70 of the end plug 5. A counter bracket 30 is pivotably arranged within the housing 10 and can pivot about a pivoting axis 32. The counter bracket 30 is pre-tensioned towards an insertion position by a spring 34 which is schematically shown in FIG. 9.

The insertion slot 20 is formed by an upper and a lower guide rail in the housing, the upper guide rail 200 of which is shown in the cross-section of FIG. 9. The insertion slot 20 has an end position 250 in which the end plug 5 can be retained. The end plug 5 is slid along the insertion slot 20, meshing with the guide rails, and then pivots said pivotable bracket 30 in a direction towards the exterior walls of the housing 10. The pivoting is effected about a pivot axis extending at right angles to the longitudinal axis L of the pin 80. Then the end plug 5 is slid further along the guide rails and brought into the end position 250. In the end position 250, the bearing pin 80 of the end plug 5 sits inside a conical recess.

In contrast, FIG. 1 shows an outside view of a retention mechanism 1 according to an embodiment of the present invention. The retention mechanism 1 is provided for receiving and retaining an end plug of an exchangeable paper roll and would be arranged on one of the two support arms of a dispenser.

As shown in FIG. 1, the retention mechanism 1 includes a housing 2 which is approximately box-shaped. The housing has a front wall 21 which, in the mounted state of the dispenser, would be arranged substantially vertical and facing the second support arm (not shown). The housing further includes a first side wall 22 which runs substantially perpendicular to the front wall 21 and faces towards the user in the mounted state of the dispenser. A second, opposite side wall of the housing 2 is designated 23 (see also FIG. 5*a*). An upper wall 24 and a bottom wall 25 of the housing 2 in turn run substantially perpendicular to the front wall 21 and the side walls 22, 23 and would be arranged approximately horizontal in the mounted state of the dispenser.

The open back face of the housing 2, i.e. the side of the housing 2 which is opposite the front wall 21, is closed by means of a back plate 10. The back plate 10 is fixed to the housing 2 by means of a screw (not shown).

An insertion slot 4 is provided so as to extend within the front wall 21 of the housing 2. More particularly, the entrance to the insertion slot 4 opens within the first side wall 22 of the housing 2, and the insertion slot 4 extends from said entrance along the front wall 21 so that the main direction of extension of the insertion slot 4 is along the front wall 21. An end plug 5 of the type described above with reference to FIGS. 8 and 9 is about to be inserted into the slot 4. A longitudinal axis of the end plug 5 is designated "L".

Figure 2A:
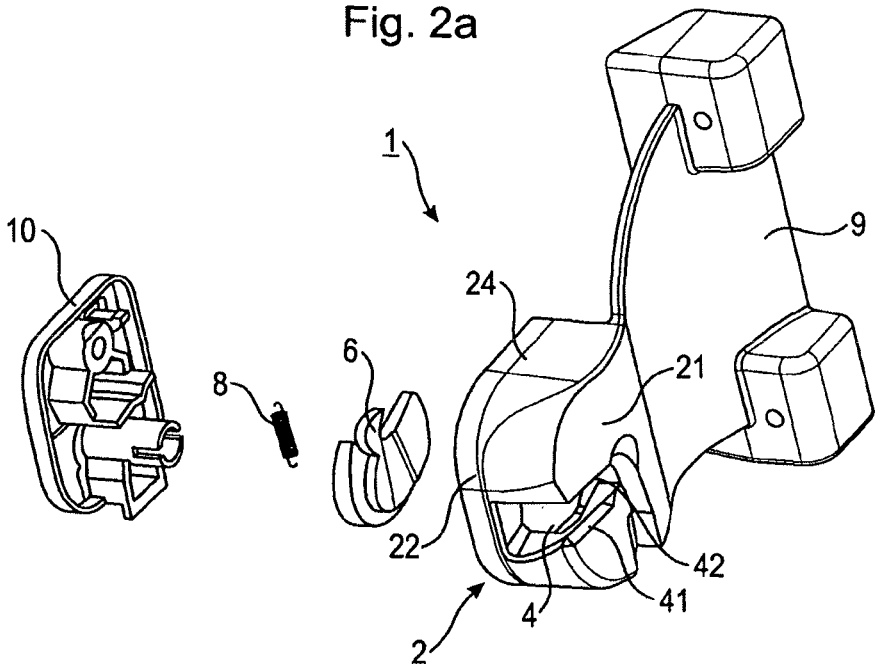
FIG. 2*a* is a disassembled view of a support arm including the exemplary retention mechanism of FIG. 1.

FIG. 2*a* is an illustration of a support arm including the retention mechanism 1 in a disassembled state, also showing the remaining constituents thereof: apart from the housing 2 including the insertion slot 4, and the back plate 10, the mechanism 1 further includes a cam lock 6 and a coil spring 8, which, in the assembled state, are accommodated in a chamber formed by the housing 2 and the back plate 10.

Reference numeral 9 designates a frame of the support arm.

Figure 2B:
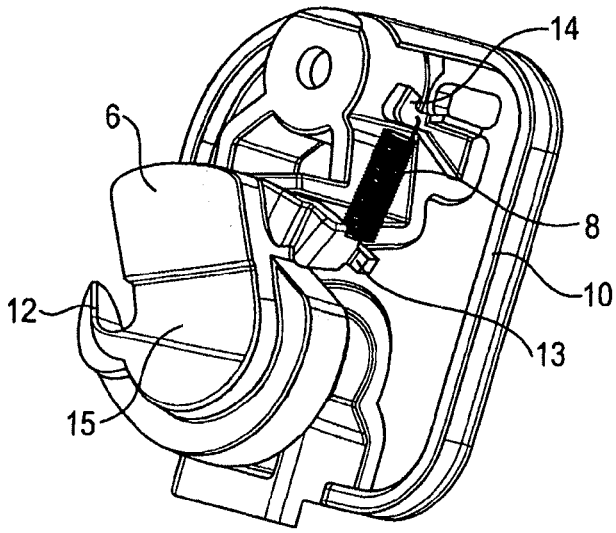
FIG. 2*b* is a view of a back plate, cam lock and coil spring.

As shown in FIG. 2*b*, the cam lock 6 is rotatably mounted to the back plate 10. One end of the coil spring 8 is attached to a protrusion 13 formed on the cam lock 6, and the other end thereof is fixed to a protrusion 14 formed on the inner surface of the back plate 10. In this manner, the coil spring 8 biases the cam lock 6 into a predetermined rotational position which will be referred to as an "open" position.

The cam lock 6 is roughly disk shaped and is arranged substantially parallel to the front wall 21 of the housing 2 and to the back plate 10. The cam lock 6 includes a retaining means provided for cooperating with the end plug 5 in a manner explained further below. In the present embodiment, the retaining means is provided in the form of a hook 12. The protrusion 13 for fixing the one end of the coil spring 8 to the cam lock 6 is provided in a position substantially diametrically opposite the hook 12.

In the surface of the cam lock 6 facing the front wall 21 of the housing or facing away from the back plate 10, respectively, a shallow impression or groove 15 is formed which tapers towards the hook 12. This shallow groove 15 on the surface of the cam look 6 cooperates with a discriminator channel 7 in the housing, which will be described below with reference to FIG. 3, in order to discriminate paper rolls which are inserted with a horizontal displacement, so that the bearing pin 80 of the end plug 5 does not engage properly with the cam lock 6. This would also discriminate rolls with too short a bearing pin 80.

For assembling the retention mechanism 1, the back plate 10 is connected with the housing 2 so that the cam lock 6 is accommodated within a space provided between the back plate 10 and the housing 2.

Figure 3:
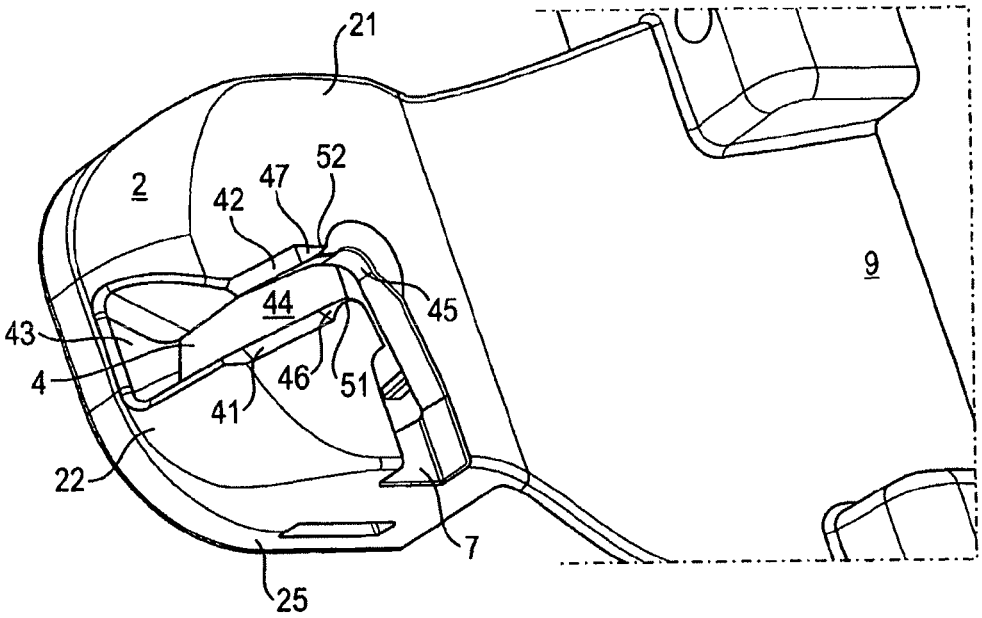
FIG. 3 is a perspective view of a housing.

FIG. 3 is an enlarged perspective view of the housing 2 including the insertion slot 4. From the Figure it becomes clear that the insertion slot 4 is generally constituted by three sections: an entrance section 43 through which the bearing pin 80 of the end plug 5 enters the slot 4, a sliding section 44 along which the bearing pin 80 slides, and a locking section 45 which corresponds to the final position of the bearing pin 80.

The insertion slot 4 further forms two supporting surfaces for supporting the bearing pin 80 when it is being slid through the insertion slot 4, the two supporting surfaces being arranged such that they face each other. Such supporting surfaces in turn include guide rails 41, 42 that extend along the insertion slot 4 in a direction perpendicular to the supporting surfaces. The arrangement of said guide rails 41, 42 is such that the two guide rails 41, 42 situated on the upper and on a lower supporting surface, respectively, are arranged such that they face each other. The guide rails 41, 42 have a minimum distance in between each other in the direction perpendicular to the support surfaces, the minimum distance being such that it corresponds to the diameter $d_3$ of a shoulder portion 88 of a bearing pin 80 suitable for use with the present retention mechanism 1 (see FIGS. 8 and 9 and the corresponding description above). This is one of the features which ensure that only appropriately dimensioned bearing pins 80, namely bearing pins 80 having a shoulder portion 88 of dimensions corresponding to the guide rails 41, 42, can be inserted into the insertion slot 4.

The guide rails 41, 42 are formed for guiding the bearing pin 80 of an end plug 5 when travelling within the slot 4. More particularly, the upper and lower guide rails 42, 41 provided in the housing 2 engage with the cone 90 of the bearing pin 80. To this extent, the guide rails 41, 42 are formed tapering into the insertion slot 4 towards their minimum distance, so as to match with the shape of the cone 90.

These guide rails 41, 42 merge into interference features which help in retaining the end plug 5 within the insertion slot 4. These interference features are provided in the form of swellings or bulges 51, 52 which are formed adjacent to the guide rails 41, 42 of the housing 2 so as to face each other. The bulges 51, 52 are formed between the sliding section 44 and the locking section 45 of the insertion slot 4. The transition between the guide rails 41, 42 and the bulges 51, 52 is in turn constituted by slopes 46, 47 which are so formed that the bulges 51 protrude further into the insertion slot 4 and also in a direction perpendicular to the insertion slot 4 than the guide rails 41, 42 do.

Reference numeral 7 designates a discriminator channel through which end plugs, which are not suitable for cooperating with the present retention mechanism, may fall through. The discriminator channel 7 cooperates with the shallow groove 15 formed in the surface of the cam lock 6 in order to discriminate paper rolls which are inserted with a horizontal displacement or with too short a bearing pin 80.

Figure 4:
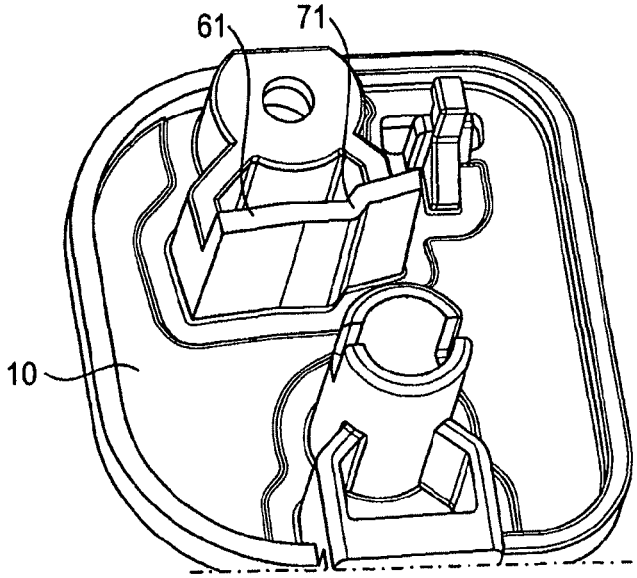
FIG. 4 is an enlarged perspective view of the back plate of FIG. 2*b;*

FIG. 4 is an enlarged perspective view of the inner side of the back plate 10. On this inner surface, which faces the housing 2 in the assembled state, the back plate 10 also has a guide rail 61 which is provided for guiding the head portion 84 of the bearing pin 80 within the insertion slot 4. This guide rail 61 is provided with an interference feature in the form of a buckle or bend 71 of the guide rail 61, which protrudes into the insertion slot 4 and also helps retaining the end plug 5 within the insertion slot 4.

The process of installing an end plug 5 of an exchangeable paper roll into the present retention mechanism 1 will now be explained with reference to FIGS. 5*a* to 5*d*. These Figures show perspective views of the housing 2 of the retention mechanism 1 into which a bearing pin 80 of an end plug 5 is inserted. (Note that the end plug 5 as such would be located behind the housing 2 and is therefore not illustrated.) The back plate 10, with which the housing 2 would be closed, is also not shown in these illustrations.

Figure 5A:
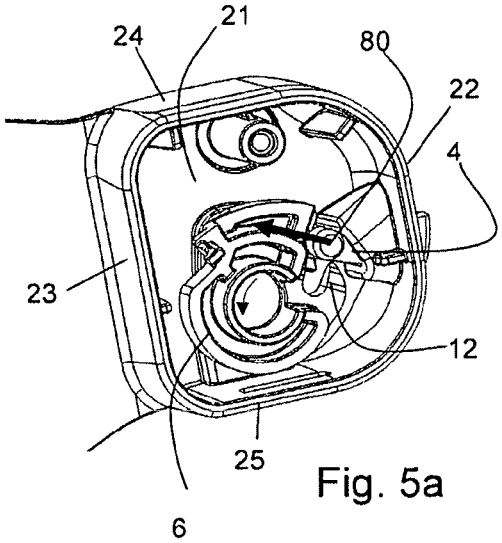
FIGS. 5*a-d* is a sequence of four views showing the process of inserting a correct end plug into the exemplary retention mechanism of FIG. 1.

FIGS. 5*a* to 5*d* illustrate how the end plug 5 and the retention mechanism operate when a user attaches a new paper roll including the end plug 5 to the retention mechanism. FIG. 5*a* shows the starting situation in which the user begins inserting the end plug 5 into the insertion slot 4 provided in the housing 2. During the mounting process, the paper roll and therefore also the bearing pin 80 of the end plug 5 are held in a substantially horizontal position while the roll is pushed into the insertion slot 4.

The coil spring 8 (not shown here) keeps the cam lock 6 in the open position ready for a new roll to be installed. The bearing pin 80 of the end plug 5 begins travelling into the insertion slot 4. The pin 80 travels in the insertion direction indicated by a thick arrow. During its travel along the insertion slot 4 the pin 80 engages with the cam lock 6 and applies a rotational movement to the cam lock 6 which is rotationally supported. The counter-clockwise rotational direction of the cam lock 6 is also indicated by means of an arrow. The rotation of the cam lock 6 takes place in a rotational plane which is substantially parallel to the front wall 21 of the housing 2 in which the slot 4 is formed, and also substantially parallel to the direction of extension of the insertion slot 4, which corresponds to the insertion direction of the pin 80. This means that the rotational axis R of the cam lock 6 is also substantially parallel to the longitudinal axis L of the bearing pin 80.

Figure 5B:
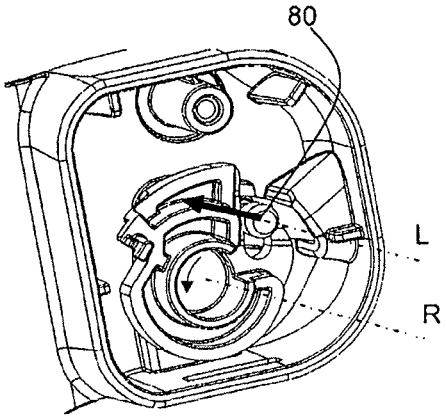
Figure 5C:
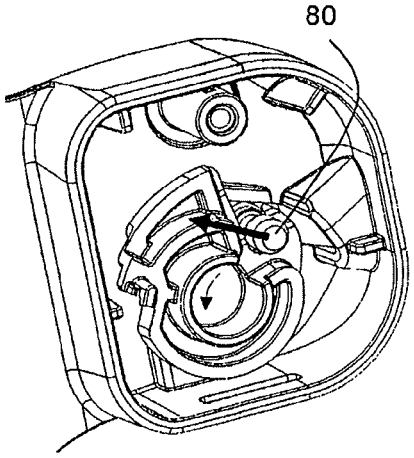

From FIGS. 5*b* and 5*c* it becomes clear that the pin 80 continues travelling along the insertion slot 4 and imparts a rotation onto the cam lock 6 such that the retaining means or hook 12 of the cam lock 6 engages with the pin 80. More particularly, the hook 12 engages with the neck portion 86 of the bearing pin 80 which is located between the head 84 and the shoulder portion 88 thereof and has the comparatively small diameter $d_2$. The head portion 84 of the pin, having the larger diameter $d_1$, is guided by means of the guide rail 61 of the back plate 10 (not shown here). The cone 90 of the pin is guided by means of the guide rails 41, 42 of the housing 2. The further the pin 80 is pushed along the insertion slot 4, the further the cam lock 6 rotates, and the more the hook 12 engages with the neck portion 86 of the bearing pin 80. Note that at this stage, the hook 12 moves within a space formed between the guide rails 41, 42 of the housing 2, which guide the cone 90 of the pin 80, and the guide rail 61 of the back plate, which guides the head portion 84 of the pin 80.

If, in contrast, a paper roll is inserted with a horizontal displacement, and the bearing pin 80 of the end plug 5 of the paper roll does not engage properly with the hook 12 of the cam lock 6, this paper roll would slide through the shallow groove 15 on the surface of the cam lock 6 and the discriminator channel 7 formed in the housing. The same applies to paper rolls with end plug 5 the bearing pin 80 of which is too short to become properly engaged with the hook 12 of the cam lock 6.

During its travel along the insertion slot 4 the pin 80 passes different interference features which help in retaining the end plug 5 within the insertion slot 4.

A first interference feature is provided in the form of the bulges 51, 52 which are formed adjacent to the guide rails 41, 42 of the housing 2 so as to face each other. The cone 90 of the bearing pin 80 (see FIG. 1) passes these bulges 51, 52 on its way along the insertion slot 4. The bulges 51, 52 do not only extend further into the insertion slot 4 than the guide rails 41, 42, but also in a direction perpendicular to the insertion slot 4, i.e. in the direction of extension of the pin 80. When the cone 90 of the pin 80 passes the bulges 51, 52, the pin 80 is urged away from the back plate 10 in its longitudinal direction. This means that the underside of the pin head 84 draws the cam lock 6 or the hook 12 thereof, respectively, towards the housing 2, and a certain friction is established between the hook 12 and the housing 2. In order to achieve this effect, a distance d between the underside of the pin head 84 and the facing end face 68 of the receiving portion 60 of the end plug 5 must be dimensioned appropriately: this distance d is slightly smaller than the thickness of the hook 12 plus the thickness of the bulges 51, 52 in the wall of the housing 2, as seen in the longitudinal direction of the bearing pin 80. This makes it possible to establish the required friction between the hook 12 and the bulges 51, 52 by jamming these elements between the underside of the pin head 84 and the facing end face 68 of the receiving portion 60 of the end plug 5.

When the cone 90 of the pin 80 has passed the said bulges 51, 52, this friction is released again to some extent, but a part of the friction is maintained so as to retain the pin 80 within the inner end portion of the insertion slot 4.

As explained above, the back plate 10 also has a guide rail 61, which guides the head portion 84 of the bearing pin 80. A bend 71 is formed on this guide rail, which the head portion 84 of the pin 80 also has to pass when travelling along the insertion slot 4. The bend 71 on the back plate guide rail 61 protrudes into the insertion slot 4 and also helps retaining the end plug 5 within the inner end portion of the insertion slot 4.

Furthermore, the bulges 51, 52 adjacent the housing guide rails 41, 42 and the bend 71 of the back plate guide rail 61 provide a tactile and/or audible feedback informing the user that the end plug 5 has been correctly inserted.

The bulges 51, 52 on the housing guide rails 41, 42 on the one hand and the bend 71 in the back plate guide rail 61 on the other hand are provided so that the pin 80 arrives at all these interference features at the same time. However, they could also be shifted so that the pin 80 first passes the bulges 51, 52 provided adjacent the housing guide rails 41, 42 and passes the bend 71 in the back plate guide rail 61 only subsequently, or vice versa.

Figure 5D:
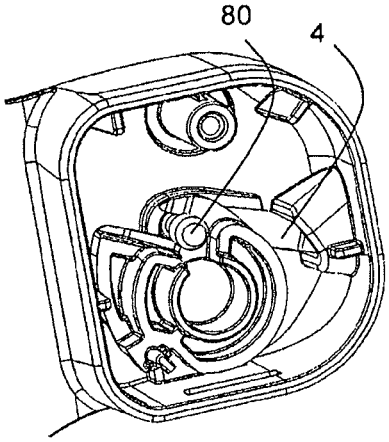
Figure 6A:
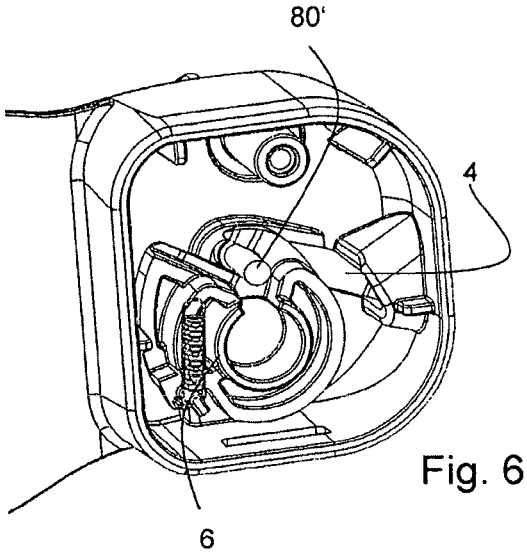
FIGS. 6*a-d* is a sequence of four views showing the process of inserting an incorrect end plug into the exemplary retention mechanism of FIG. 1.
Figure 6B:
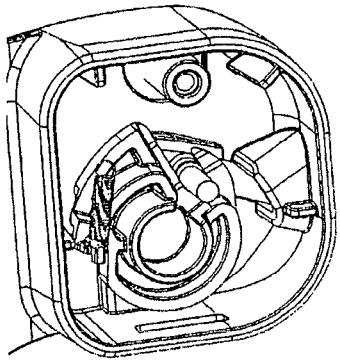
Figure 6C:
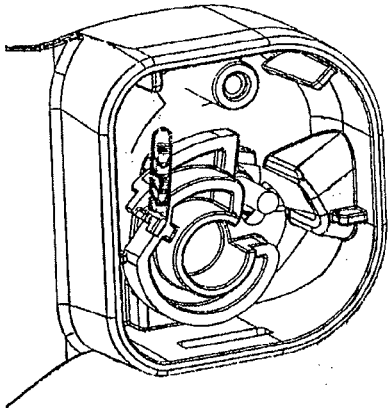
Figure 6D:
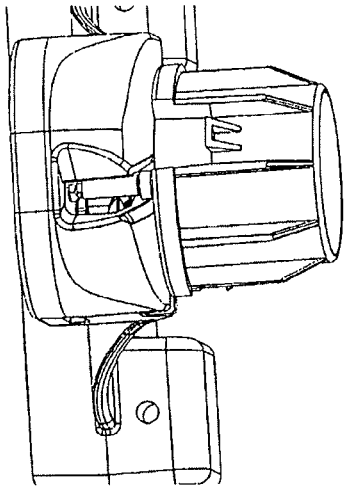

In the state shown in FIG. 5*d*, full engagement between the hook 12 and the pin 80 has been reached. The pin 80 has also reached its final position at the inner end portion of the insertion slot 4, i.e. at the locking section 45 of the insertion slot 4, and could not move any further in the direction indicated by the thick arrow.

The end plug 5 is allowed to spin freely in this locked position.

The end plug 5 cannot be removed from the retention mechanism unless a force is applied to overcome the friction between the cam lock 6 and the housing 2 as well as the retaining protrusions formed on the respective guide rails. To remove the end plug 5, essentially the same amount of force as for installing the plug 5 is required. Normal use of the dispenser under typical dispensing conditions should not allow for any reaction forces high enough and/or in the proper direction to cause the end plug 5 to disengage.

FIGS. 6*a* to 6*d* show what happens in case an end plug with inappropriate dimensions is inserted into the insertion slot 4. It will be rejected. In FIGS. 6*a* to 6*d* the bearing pin 80' has about the same, small diameter along its whole length and lacks a head portion. Such a small diameter pin would enter the insertion slot 4 and also impart the required rotational movement to the cam lock 6. However, as the pin lacks a head portion, there would be no friction established between the hook 12 of the cam lock 6 and the housing 2. The pin would not remain in the locked position, but the cam lock 6 would be rotated into the open position by means of the coil spring 8, ejecting the pin from the insertion slot.

Figure 7A:
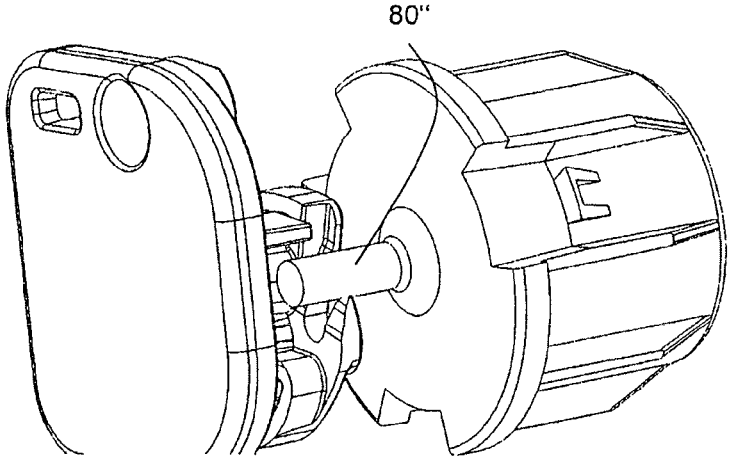
FIGS. 7*a-b* is a sequence of two views showing the process of inserting another incorrect end plug into the exemplary retention mechanism of FIG. 1.
Figure 7B:
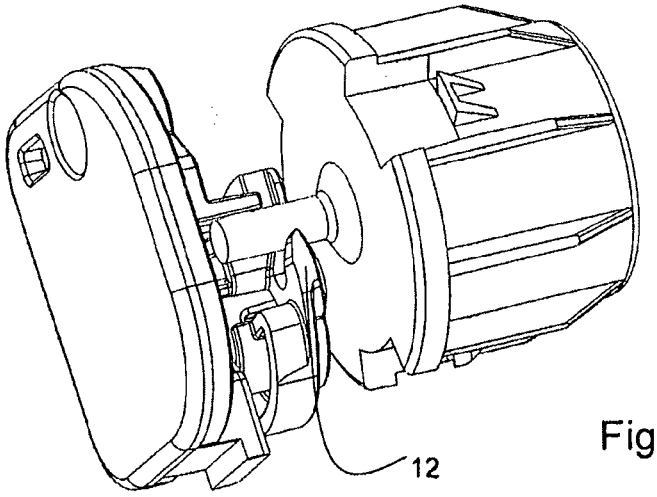

Also an end plug having a larger diameter pin would not be retained in the present retention mechanism. FIGS. 7*a* and 7*b* show a pin 80", the diameter of which is too large to fit into the hook 12 of the cam lock 6. The oversized pin could not even reach the locked position. The spring biased cam lock 6 would then force the end plug back out of the insertion slot.

In both cases, the end plug cannot be fixed at the required end position. In this manner, it is ensured that only end plugs with bearing pins having appropriate dimensions can be inserted into the retention mechanism. This helps to ensure that only material rolls with proper properties are inserted into the dispensing apparatus. It is, thus, prohibited that the dispensing apparatus is used with materials of the wrong specifications which may lead to clogging or the destruction of the apparatus.

What is claimed is:

1. A retention mechanism in a dispenser for retaining an exchangeable roll of material, the retention mechanism comprising:

a housing including a front wall, wherein an insertion slot for a bearing pin of an end plug of the exchangeable roll extends along the front wall, and a cam lock, which is arranged in the housing so as to be rotatable in a plane which is parallel to the front wall and to the direction of extension of the insertion slot, wherein the cam lock includes a retaining member which is movable between an open position and a locked position by rotating the cam lock, the cam lock being pre-tensioned into the open position, wherein, when the retaining member is in the open position, the bearing pin can be inserted into the insertion slot, and wherein, when the retaining member is in the closed position, the bearing pin is retained in a locking section of the insertion slot.

2. The retention mechanism of claim 1, which is so arranged that a movement of the bearing pin along the insertion slot causes an engagement between the pin and the retaining member, a rotation of the cam lock and accordingly a movement of the retaining member into the locked position.

3. The retention mechanism of claim 1, wherein the retaining member of the cam lock and the housing are so arranged as to cooperate with the bearing pin in order to retain the bearing pin within the locking section of the insertion slot.

4. The retention mechanism of claim 1, wherein the insertion slot includes an entrance section, a sliding section, and the locking section, and is delimited by an upper and a lower supporting surface, at least one of which includes a guide rail extending along at least part of the sliding section, and wherein the guide rail or rails are arranged and constructed for guiding the bearing pin along the insertion slot and into the locking section.

5. The retention mechanism of claim 1, wherein the housing comprises an interference member formed alongside the insertion slot, wherein the bearing pin passes the interference member on its way along the insertion slot and into the locking section thereof, and wherein the interference member helps retain the bearing pin within the insertion slot and/or provide a tactile and/or audible feedback for the user indicating that the exchangeable roll of material has been correctly inserted.

6. The retention mechanism of claim 5, wherein the interference member in the form of at least one bulge formed on the upper and/or the lower supporting surface delimiting the insertion slot so as to extend further into the insertion slot and/or in a direction perpendicular thereto than the guide rails.

7. The retention mechanism of claim 1, wherein the housing has an open back face which is closed by a back plate.

8. The retention mechanism according to claim 7, wherein the back plate has another guide rail for guiding the bearing pin along the insertion slot.

9. The retention mechanism according to claim 7, wherein the back plate further comprises an interference member which the bearing pin passes on its way along the insertion slot and into the locking section thereof, wherein the interference member helps retain the bearing pin within the insertion slot and/or provide a tactile and/or audible feedback for the user indicating that the exchangeable roll of material has been correctly inserted.

10. The retention mechanism of claim 9, wherein the interference member of the back plate is provided as a bend formed in a guide rail thereof, so as to protrude into the insertion slot and/or in a direction perpendicular thereto.

11. The retention mechanism according to claim 1, wherein the retaining member of the cam lock is provided in the form of a hook arranged and constructed for cooperating with a neck portion of the bearing pin.

12. A retention system comprising the retention mechanism according to claim 1, the end plug having a receiving portion with dimensions to fit into a hollow core of the roll of material and the bearing pin, the bearing pin having a head portion having a first diameter and a neck portion of a second diameter smaller than the first diameter, the dimensions of the end plug being such that the bearing pin is insertable into the insertion slot and is lockable in the locking section of the insertion slot of the cooperation between the bearing pin, the retaining member of the cam lock, and the housing.

13. A dispenser for exchangeable paper rolls comprising a support arm accommodating the retention mechanism according to claim 1 for retaining the end plug of the paper roll.

14. A method for inserting an exchangeable roll of material into the retention mechanism according to claim 1, the roll comprising at least one end plug having a receiving portion with dimensions to fit into a hollow core of the roll of material and the bearing pin, the bearing pin having a head portion having a first diameter and a neck portion of a second diameter smaller than the first diameter, the dimensions of the end plug being such that the bearing pin is insertable into the insertion slot and is lockable in an end position within the insertion slot by the retaining mechanism of the cam lock, the method comprising the steps of:

placing the bearing pin of the end plug into an entrance section of the insertion slot of the retention mechanism; and sliding the bearing pin along a sliding section of the insertion slot, thereby bringing the retaining member of the cam lock into engagement with the bearing pin, imparting a rotational movement onto the cam lock in the plane which is parallel to the front wall and to the direction of extension of the insertion slot, and bring the retaining member of the cam lock from the open position into the locked position.

* * * * *